US008166661B2

(12) United States Patent
King

(10) Patent No.: US 8,166,661 B2
(45) Date of Patent: May 1, 2012

(54) SHAVING SYSTEM COMPRISING A RAZOR HANDLE

(75) Inventor: William Ashley King, Marlow (GB)

(73) Assignee: Knowledge & Merchandising Inc. Limited, Chesham, Buckinghamshire (GB)

( * ) Notice: Subject to any disclaimer, the term of this patent is extended or adjusted under 35 U.S.C. 154(b) by 183 days.

(21) Appl. No.: 12/675,872

(22) PCT Filed: Aug. 29, 2008

(86) PCT No.: PCT/GB2008/050758

§ 371 (c)(1),
(2), (4) Date: Mar. 1, 2010

(87) PCT Pub. No.: WO2009/027747

PCT Pub. Date: Mar. 5, 2009

(65) Prior Publication Data

US 2010/0281698 A1 Nov. 11, 2010

Related U.S. Application Data

(60) Provisional application No. 61/051,067, filed on May 7, 2008, provisional application No. 61/051,086, filed on May 7, 2008.

(30) Foreign Application Priority Data

Aug. 31, 2007 (GB) ..... 0716941.0
Apr. 8, 2008 (GB) ..... 0806355.4
Apr. 8, 2008 (GB) ..... 0806357.0

(51) Int. Cl.
*B26B 21/52* (2006.01)

(52) U.S. Cl. ..... 30/527; 30/40.2; 30/50; 30/532

(58) Field of Classification Search ..... 30/40.2, 30/527, 532, 50
See application file for complete search history.

(56) References Cited

U.S. PATENT DOCUMENTS 3,317,995 A 5/1967 Bord (Continued)

FOREIGN PATENT DOCUMENTS

DE 20 2006 011254 U1 7/2006

(Continued)

OTHER PUBLICATIONS

GB0815742.2 Search Report, Nov. 6, 2009.

(Continued)

*Primary Examiner* — Hwei C Payer
(74) *Attorney, Agent, or Firm* — Fay Sharpe LLP

(57) ABSTRACT

A shaving system comprises a bifurcated razor handle (1,90) comprising a unitary, two-shot plastics molding having a pair of hinges (4) with elastomeric springs (11) joined by a cartridge mounting portion (30,91) which receives the bottom side of a generally flat, multi-blade cartridge (60) in fixed, snap-fit relation. The cartridge is retained in a dispenser (80) beneath a resilient leaf (84) and pressed onto the mounting portion along an engagement axis E normal to the shaving plane, the leaf being received in a recess (48) between the mounting portion and the cartridge. The cartridge is then retracted from the dispenser along a retraction axis R generally parallel with the shaving plane. The mounting portion includes digit-receiving regions (40) for pressing the mounting portion onto the cartridge, an ejection element (41,141) for disengaging the cartridge from the handle, and an elastomeric skin-engaging platform (51) arranged in advance of the shaving plane.

23 Claims, 11 Drawing Sheets

U.S. PATENT DOCUMENTS

| | | | | |
|---|---|---|---|---|
| 3,854,201 | A | 12/1974 | Dawidowicz | |
| 4,034,892 | A | 7/1977 | Braginetz | |
| 4,173,285 | A | 11/1979 | Kiraly | |
| 4,742,909 | A | 5/1988 | Apprille | |
| 4,955,136 | A | 9/1990 | Diaz-Rivera | |
| 5,535,518 | A | 7/1996 | Althaus | |
| 5,661,907 | A | 9/1997 | Apprille | |
| 5,933,960 | A | 8/1999 | Avidor | |
| 6,041,926 | A * | 3/2000 | Petricca et al. | 206/356 |
| 6,192,586 | B1 * | 2/2001 | Metcalf et al. | 30/47 |
| 6,223,442 | B1 * | 5/2001 | Pina | 30/527 |
| 6,651,342 | B1 | 11/2003 | Walker | |
| 7,874,076 | B2 * | 1/2011 | Gratsias et al. | 30/526 |
| 2002/0066186 | A1 | 6/2002 | White | |
| 2004/0055159 | A1 | 3/2004 | Khomari | |
| 2004/0181954 | A1 * | 9/2004 | Follo et al. | 30/527 |
| 2005/0102847 | A1 * | 5/2005 | King | 30/527 |
| 2005/0198825 | A1 | 9/2005 | Apprille | |
| 2006/0064875 | A1 | 3/2006 | Follo | |
| 2006/0080839 | A1 * | 4/2006 | Hesketh | 30/50 |
| 2006/0143925 | A1 * | 7/2006 | Johnson et al. | 30/50 |
| 2006/0236546 | A1 * | 10/2006 | Johnson et al. | 30/50 |
| 2007/0028449 | A1 * | 2/2007 | King | 30/49 |
| 2009/0288299 | A1 * | 11/2009 | Denkert et al. | 30/50 |
| 2009/0288304 | A1 * | 11/2009 | Denkert et al. | 30/346.61 |
| 2010/0205808 | A1 * | 8/2010 | King | 30/34.2 |
| 2010/0251555 | A1 * | 10/2010 | Park et al. | 30/532 |
| 2010/0263220 | A1 * | 10/2010 | Bruno et al. | 30/531 |
| 2010/0281698 | A1 * | 11/2010 | King | 30/527 |
| 2011/0088269 | A1 * | 4/2011 | Walker et al. | 30/527 |

FOREIGN PATENT DOCUMENTS

| | | | | |
|---|---|---|---|---|
| EP | 0429174 | A2 | | 5/1991 |
| EP | 1531030 | A | | 5/2002 |
| EP | 1252981 | A | | 10/2002 |
| FR | 2805197 | A | | 2/2000 |
| GB | 2025827 | A | | 1/1980 |
| GB | 2408010 | A | | 5/2005 |
| GB | 2 411 141 | A | | 8/2005 |
| GB | 2452411 | A | * | 3/2009 |
| GB | 2461054 | A | * | 12/2009 |
| GB | 2467480 | A | * | 8/2010 |
| JP | 2006 232325 | A | | 9/2006 |
| WO | WO 99/06190 | A1 | | 2/1999 |
| WO | WO 01/07214 | A1 | | 2/2001 |
| WO | WO 2005/090020 | A1 | | 8/2005 |
| WO | WO 2006/044394 | A2 | | 4/2006 |
| WO | WO 2006/086314 | A1 | | 8/2006 |
| WO | WO 2006/127435 | A | | 11/2006 |
| WO | WO 2009/027747 | A2 | | 3/2009 |

OTHER PUBLICATIONS

GB0806357.0 Search Report, Aug. 6, 2008.
GB0806355.4 Search Report, Aug. 6, 2008.
GB0716941.0 Search report, Jan. 18, 2008.
GB0815746.3 Search report, Dec. 19, 2008.
International Search Report, PCT/GB2008/050759, Apr. 2007.
Written Opinion, PCT/GB2008/050759, Apr. 2005.
International Search Report, PCT/GB2008/050758, Apr. 2007.
Written Opinion, PCT/GB2008/050758, Apr. 2005.

* cited by examiner 1
11'''
P
11
3
11''

XL
α1
3
P
30
PL1
51
36

52
E
S
d1
PL2
XL
1
11

65
66
60
H2
68
H1
77

51'
67
51
S

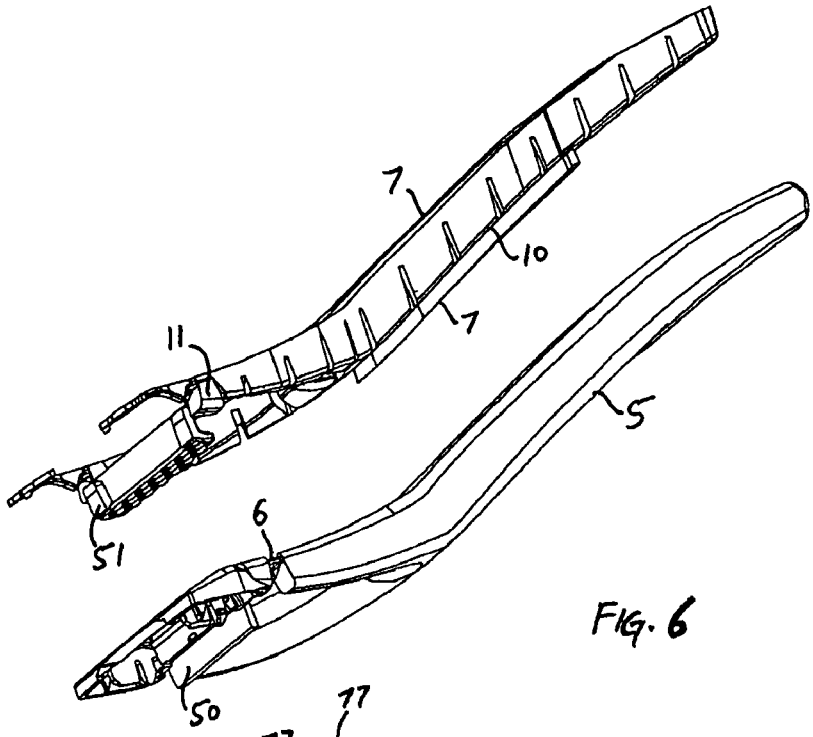
FIG. 6
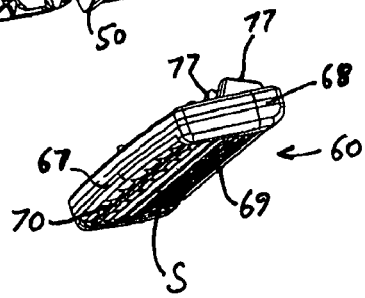
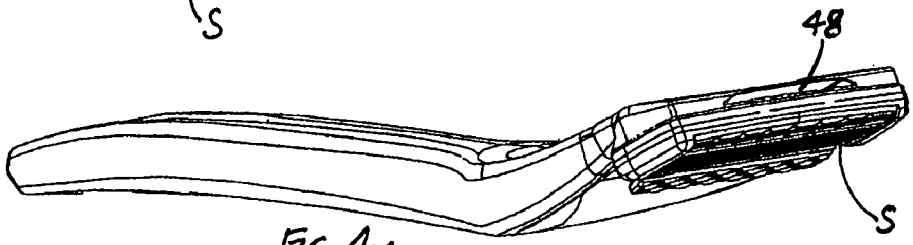
FIG. 4A
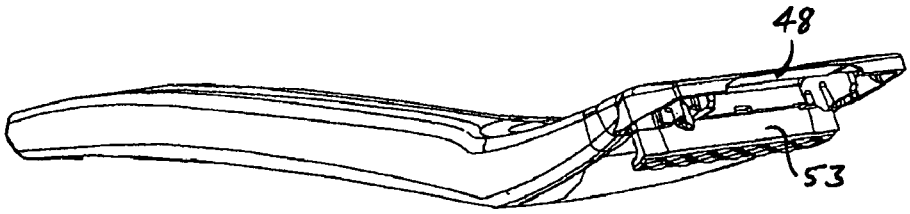
FIG. 4B
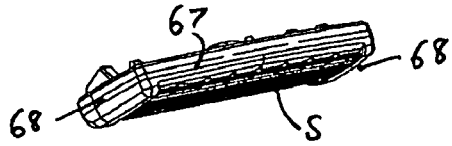

SHAVING SYSTEM COMPRISING A RAZOR HANDLE

CROSS-REFERENCE TO RELATED APPLICATIONS

This application is a national stage entry of international application number PCT/GB2008/050758, having international filing date of Aug. 29, 2008, which was published in English, and which claims priority to Great Britain Patent Application Nos. GB0716941.0, filed Aug. 31, 2007; GB0806355.4, filed Apr. 8, 2008; and GB0806357.0, filed Apr. 8, 2008, and which also claims priority to and the benefit of U.S. Provisional Patent Application Nos. 61/051,067, filed May 7, 2008 and 61/051,086 filed May 7, 2008, the entireties of which are hereby incorporated by reference as if fully set forth herein.

This invention relates to shaving systems including a razor handle and a disposable cartridge adapted for releasable attachment to the handle.

In its preferred embodiments, the invention is directed in particular to a shaving system comprising a cartridge having a plurality of sharpened cutting edges arranged in a shaving plane. Such cartridges typically provide a smoother and closer shave than the single blade used in earlier razors, but require special mounting arrangements so as to expose the shaving plane (typically the largest, flat side of the cartridge) for use.

The cutting edges are commonly provided by a plurality of blades arranged between a guard and a cap. The guard and cap are arranged respectively in front of and behind the cutting edges when considered in the direction of shaving, and together with the end portions of the blade housing comprise skin-engaging surfaces serving to determine the position of the cutting edges relative to the user's skin in use. The cutting edges, the guard and the cap lie substantially in alignment within the shaving plane, which is defined as that plane containing the guard and cap or corresponding skin-engaging surfaces in use, while the exposure of each cutting edge (a determinant of the closeness of the shave) is defined as the positive or negative distance of the cutting edge above or below the shaving plane, usually measured in tens of microns.

The cartridge may comprise a plastics housing containing an assembly of two, three, four or more blades, each having a cutting edge. The cap, guard and blades may be fixedly or moveably mounted (e.g. on springs) in the housing, or the cap and guard may be integral parts of the housing. Alternatively the cartridge may comprise an assembly or even a unitary element having a plurality of cutting edges made for example from a single piece of steel, ceramic or silicon material.

Typically, a shaving system also includes a dispenser for holding new cartridges, which is preferably adapted also to receive the used cartridges so as to retain them safely prior to disposal. Preferably, the cartridges are removed from and returned to the dispenser by means of the razor handle, so that the user's fingers are not exposed to the cutting edges.

Many razor handles now available in the market provide a pivoting mechanism in which the pivot axis is arranged on the opposite side of the cartridge from the shaving plane and in-between the guard and the cap, allowing the user to apply force to the cutting edges directly in line with the pivot axis. Such pivot mechanisms help the cartridge to follow the contours of the body area being shaved, but do not effectively limit the force applied to the skin.

The K-4 Tetra Neo™ shaving system manufactured by Kai Corporation of Tokyo, Japan provides a handle having two bars with hooked distal ends which are inserted into apertures in the bottom of the cartridge, providing a pivot axis. A control button is depressible to urge the bars apart so as to detach the cartridge from the handle. The cartridges are retained in a dispenser by flat structures which extend partway over the bottom side of the cartridge and exert a resilient downward retaining force. The bars are inserted into the cartridge along a first (vertical) axis normal to the dispenser base, following which the cartridge is retracted from the dispenser along a second, inclined axis from beneath the retaining structure.

WO2005/090020 A1 discloses a shaving system having a dispenser formed in two parts and assembled by ultrasonic welding. Each cartridge includes an elastomeric protuberance for retaining it in the dispenser, and a socket attached to the blade housing by a pivoting joint. The handle includes a connection structure for insertion into the socket, with a spring biased retaining assembly having a release button that allows the handle to be disconnected and withdrawn from the socket along the axis of insertion and retraction of the cartridge into and from the dispenser.

Since all three system elements are more or less complex assemblies, the latter system is complicated to manufacture and may present difficulties in cleaning debris from the interstices of the handle and cartridge mechanisms. Some users may find difficulty in manipulating a cartridge release button. Moreover, the cartridge structure when retained in the dispenser presents a confusing array of surfaces and apertures into which the user may attempt to insert the connection structure of the handle, so care is required when changing the cartridge.

The pressure exerted against the user's skin by the cutting edges and by the cap and guard or other skin-engaging surfaces is an important factor in determining the closeness of the shave. If too much pressure is exerted, the shave may be overly aggressive so that the blades irritate or cut the user's skin. If too little pressure is exerted, the shave quality may be poor. It is therefore desirable to provide some means for limiting the pressure of the blades against the skin.

At the same time, the user should be able to exercise precise control over the position of the cartridge and to obtain tactile feedback giving a "feel" for the interaction between the cartridge and the skin via the handle during shaving.

A pivoting connection between the cartridge and the handle helps the shaving plane to remain in correct relation to the skin as it passes over the changing contours of the user's body. However, in practice it can often fail to limit the force applied to the user's skin, since the user may apply force to the cutting edges directly in line with the pivot axis while moving the cartridge in the direction of shaving. At the same time, the pivot mechanism can also make it difficult for the user to control the shaving process and to "feel" the engagement between the cutting edges and the skin through the razor handle, because the rotational position of the handle relative to the cartridge has little or no effect on the pressure of the cartridge against the skin.

GB 2 408 010 A to the present applicant discloses a one-piece razor handle formed as a unitary, two-shot moulding. The handle is bifurcated to form a pair of arms, the cartridge being releasably mounted in fixed relation to the distal ends of the arms by squeezing the arms together and then releasing them so as to engage a hook structure on the end of each arm in a cooperating aperture in the cartridge. Each arm is provided with a living hinge surrounded by an elastomeric material, providing a hinge axis which lies just in front of the guard in the direction of shaving. Pressure applied to the cartridge during shaving causes the cartridge to pivot about the hinge axis with respect to the handgrip against the restoring force of the elastomer, so that the cartridge follows the contours of the user's skin. The position and structure of the hinge effectively limits the pressure applied to the cutting edges while providing the user with tactile feedback that enables precise control of the shaving operation.

It is the object of the present invention to provide a razor handle for a shaving system which addresses some or all of the above mentioned problems so as to offer improved effectiveness and/or convenience in use and/or manufacture.

In accordance with its various aspects the invention provides a razor handle as defined in the appended claims.

Some illustrative embodiments will now be described, purely by way of example and without limitation to the scope of the claims, and with reference to the accompanying drawings, in which:—

FIGS. 1-4 show a first razor handle with a cartridge in respectively the installed position (FIGS. 1A-4A) and in exploded view (FIGS. 1B-4B);

FIG. 6 is an exploded view of the first razor handle showing the two components of the unitary moulding together with the cartridge;

Corresponding elements are indicated by the same reference numerals in each of the figures.

Referring to FIGS. 1-10, a shaving system comprises a first, re-usable razor handle 1, a replaceable and disposable cartridge 60, and a dispenser 80.

Figure 1B:
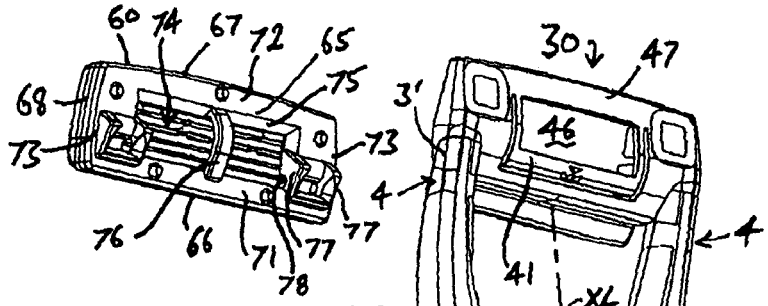
Figure 1A:
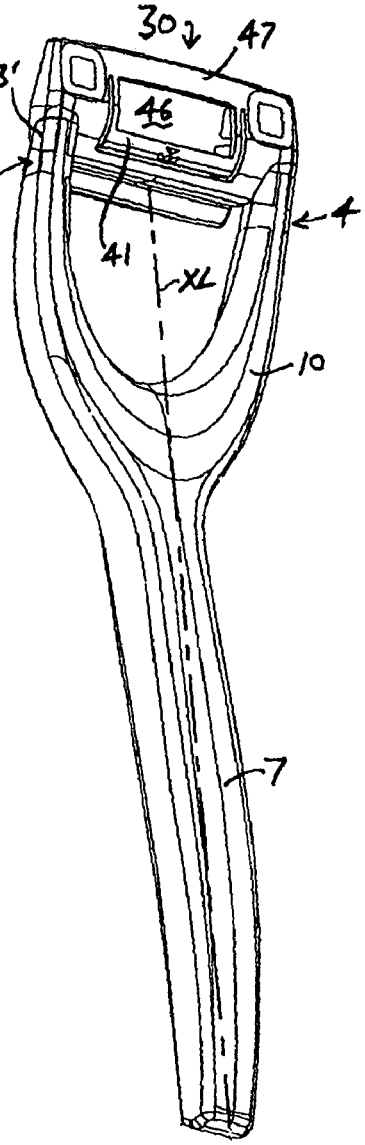
Figure 1A:
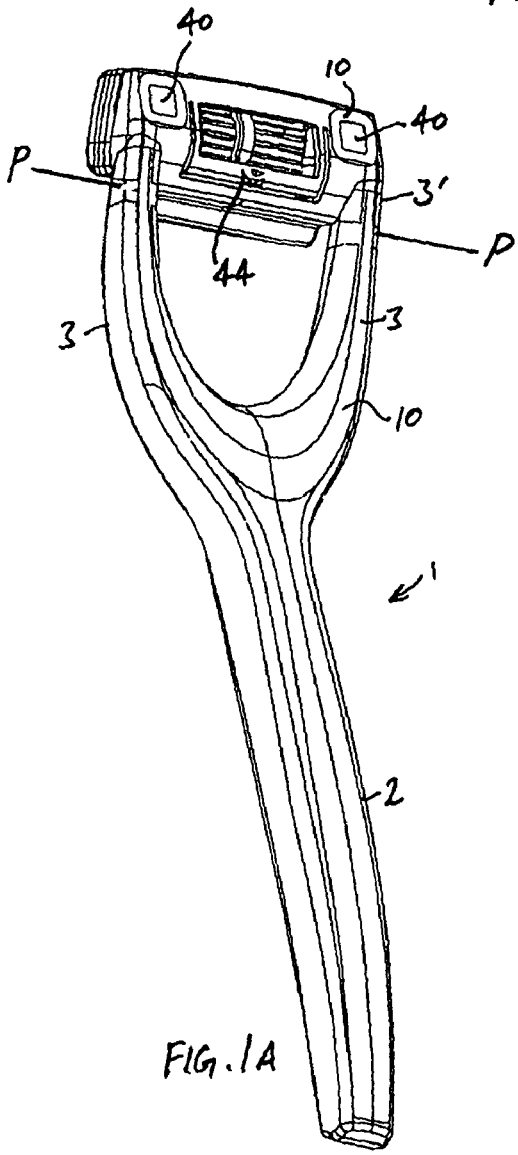
Figures 2A, 2B:
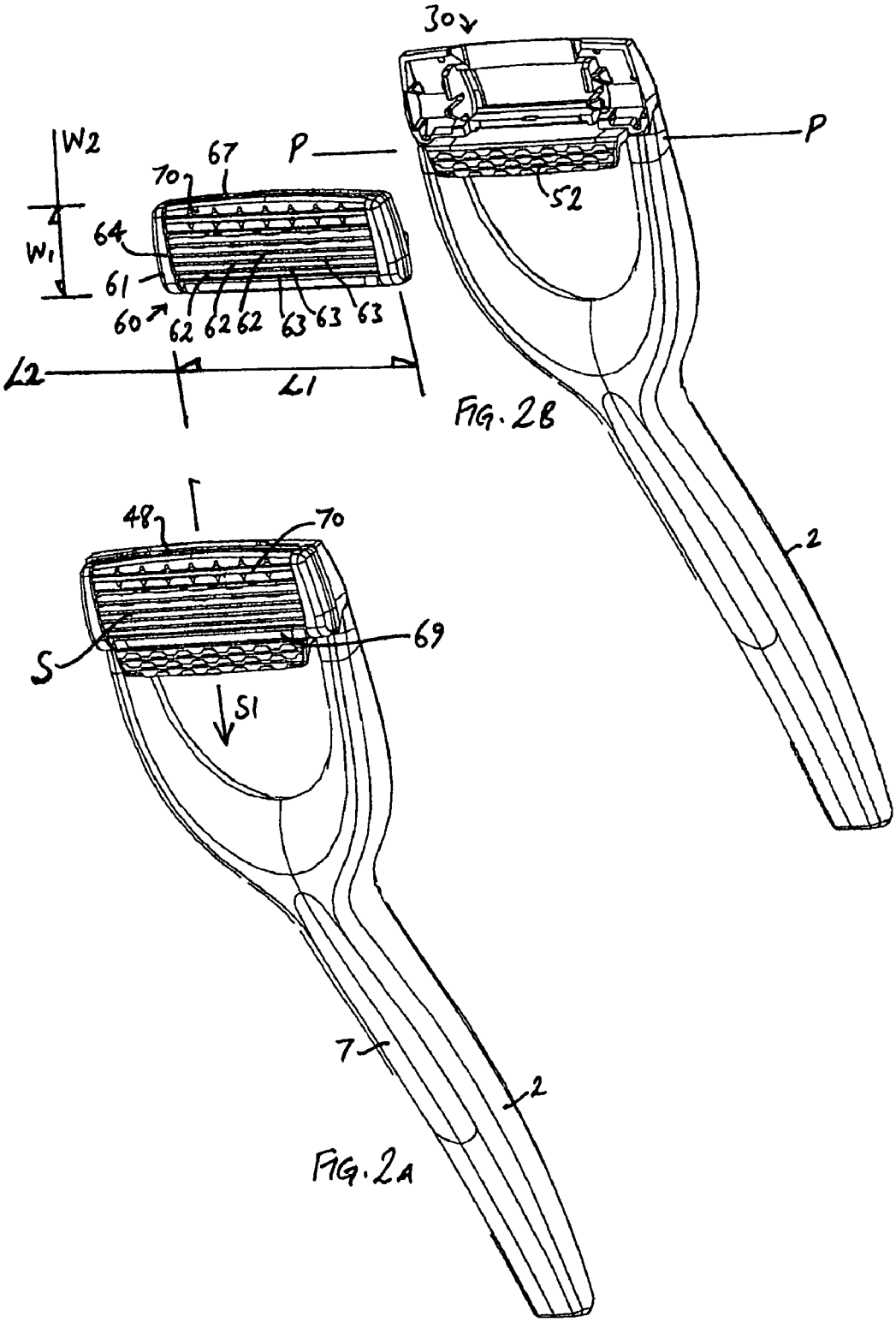
Figures 3A, 3B, 5A, 5B:
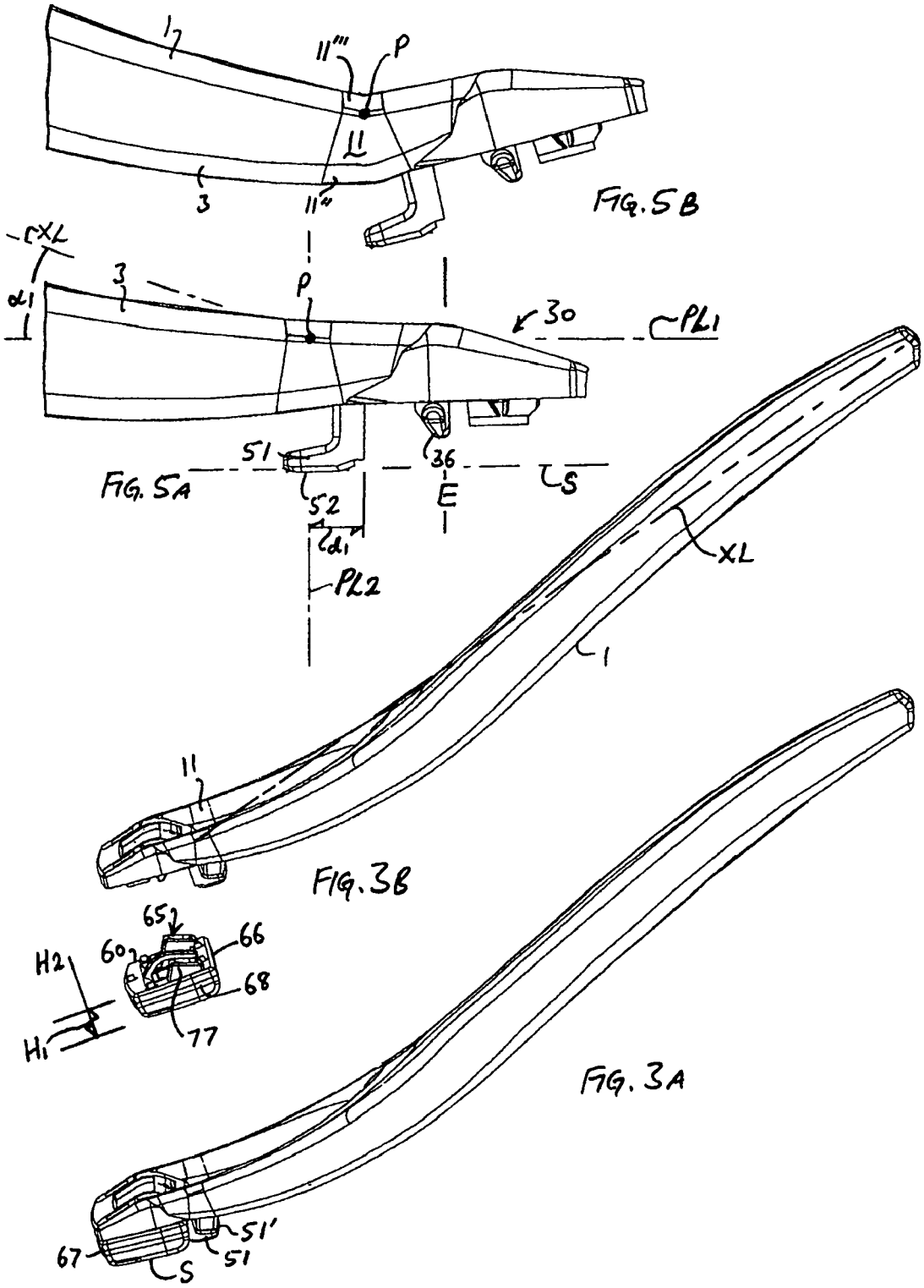
FIGS. 5A and 5B show the mounting portion of the first razor handle respectively in the rest position and in a deflected position.
Figure 7:
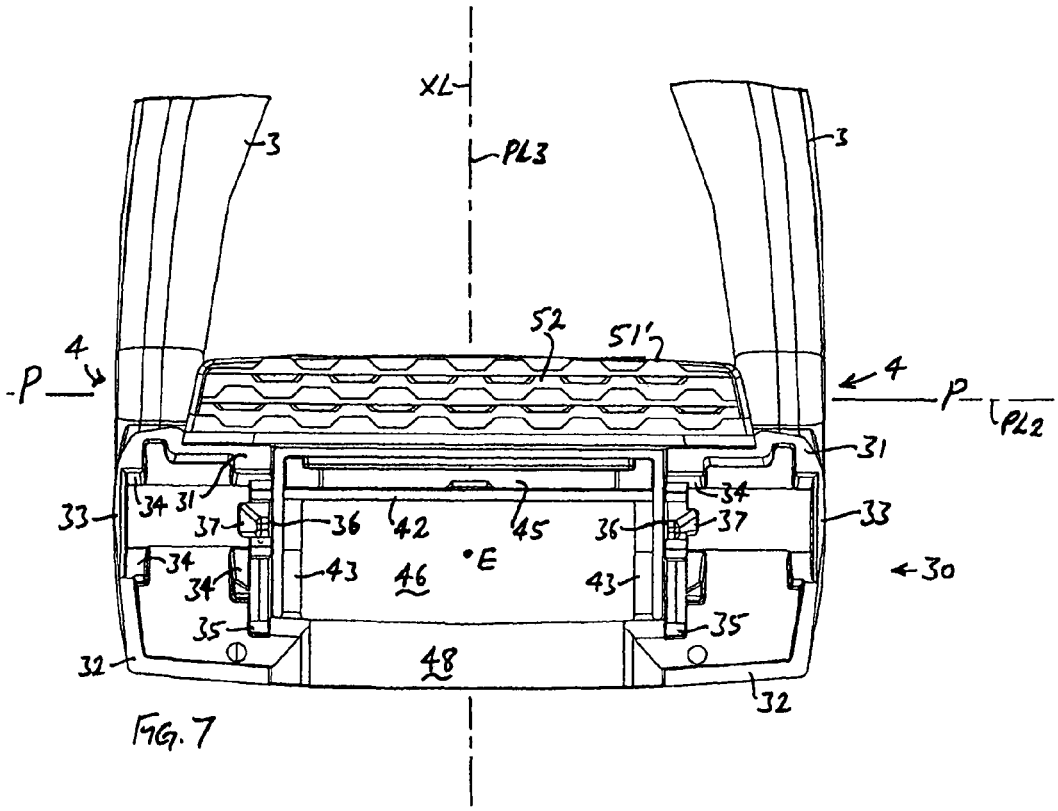
FIGS. 7 and 8 are enlarged views of the mounting portion of the first razor handle.
Figure 8:
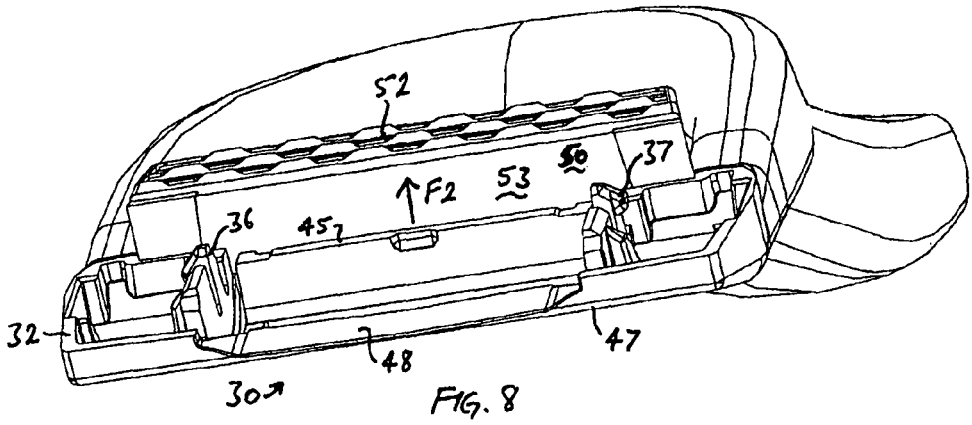

The forked handle comprises a handgrip portion 2 and a bifurcated portion comprising a pair of arms 3, each with a hinge 4. The arms are arranged between the handgrip portion and a mounting portion 30, which is attached to both hinges so that it may pivot (together with the attached cartridge 60) relative to the handgrip portion 2 about a pivot axis P defined by the two hinges, as illustrated in FIG. 5B, in response to shaving forces exerted against the cartridge.

The forked handle configuration simplifies the cartridge mounting portion, avoids obstruction of the bottom side of the cartridge so as to allow effective wash-through of the blades, and allows the user to observe between the forks (e.g. in a shaving mirror) the area of skin immediately in front of the blades so that he can see where he is about to shave.

It also provides a mechanically stable configuration with a low centre of gravity which gives improved tactile feedback when shaving, and makes it easy for the less dexterous user to apply pressure to the mounting portion while avoiding any risk of overturning the razor during engagement or disengagement of the cartridge.

The position and configuration of the handle with respect to the mounting portion also ensures that the mounting portion always trails behind the handle. This provides a smooth shaving action and makes it very difficult for the cartridge to be inadvertently applied to the skin in a gouging motion as is sometimes possible with prior art razors having a short, straight section which supports the cartridge at a point between the guard and the cap and below the shaving plane (i.e. on the opposite side of the shaving plane from the user's skin.) Generally, the smaller the angle between the longitudinal axis of the handle and the shaving plane (or a plane parallel with the shaving plane), down to an optimal angle of about 20°, the smoother and easier the shaving action.

The cartridge 60 is of a known type, comprising a plastics housing 61 containing a plurality of steel blades 62, each blade being permanently mounted in the housing and having a cutting edge 63. The cutting edges lie in a shaving plane S at the top side 64 of the housing and are arranged one behind the other in a shaving direction S1 so as to exert a consecutive cutting action in use when the shaving plane is moved across a user's skin in the shaving direction.

The top side 64 of the housing has an overall length L1 extending in a length dimension L2, and a width W1 extending in a width dimension W2, which extends in the shaving direction and transverse to the length dimension. The housing also defines a bottom side 65 opposite the top side 64, and a plurality of side walls 66, 67, 68, the side walls having a height H1 extending in a height dimension H2 between the top side and the bottom side.

The width W1 of the cartridge is typically, but not necessarily, smaller than its length L1, while the height H1 of the side walls is preferably smaller than the length, and more preferably smaller than the width, so that the cartridge preferably has a compact, flattened shape as shown. This makes the cartridge convenient and economical to manufacture, store and merchandise as well as simplifying the design of the dispenser, which in turn makes it possible for the dispenser 80 to be a unitary moulding as shown, rather than a more expensive, two-part assembly as known in the art.

The shaving plane S also contains a plurality of skin engaging surfaces defined by permanent parts of the plastics housing, including a guard 69 arranged adjacent the leading side (leading side wall 66) of the cartridge, and a cap 70 arranged adjacent its trailing side (trailing side wall 67), the guard and the cap encountering the user's skin respectively in advance of and behind the cutting edges of the blades when the cartridge is moved across the user's skin in the shaving direction S1.

The bottom side 65 of the cartridge defines flat surfaces 71, 72, 73 arranged respectively adjacent its leading side wall 66, trailing side wall 67, and end side walls 68. A curved bar 76 extends in the width dimension W2 across the centre of a wash-through aperture 74, which has a chamfer 75 at its trailing edge. Each end region of the bottom side of the cartridge also includes a pair of wings 77, the inner wing of each pair defining a recess 78 which opens into the wash-through aperture 74 and extends in the length dimension L2 of the cartridge.

The dispenser 80 comprises a one-piece plastics moulding defining a shallow tray having outer walls 81 and a generally flat base 82 and a plurality of compartments 83, each compartment extending between the longer outer walls and transverse to the longitudinal axis of the tray.

Each compartment includes a retaining structure 84 which is adapted to retain a cartridge 60 in a retained position in the respective compartment, and to release the cartridge when the cartridge is attached to the handle and retracted from the dispenser along a retraction axis R which extends generally in the width dimension W2 of the cartridge. The top side 64 of the cartridge is supported on a pair of upwardly facing sloping support surfaces 85 which extend in parallel with the retaining structure 84, which comprises a generally planar leaf extending in parallel with the retraction axis R from a support wall 86. An aperture 89 is formed in the base of the dispenser beneath each retaining structure 84, and serves to drain the used cartridges as well as facilitating removal of the dispenser from the mould as a unitary moulding.

Figure 9A:
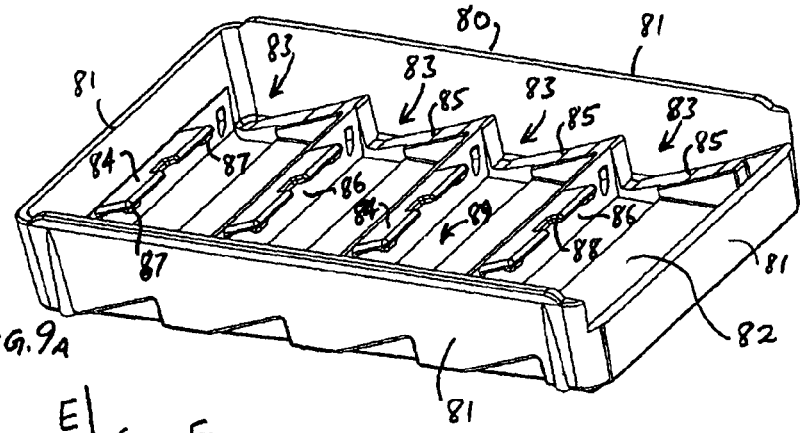
FIGS. 9A and 9B show a dispenser for use with the first razor handle, respectively empty and with retained cartridges.
Figure 9B:
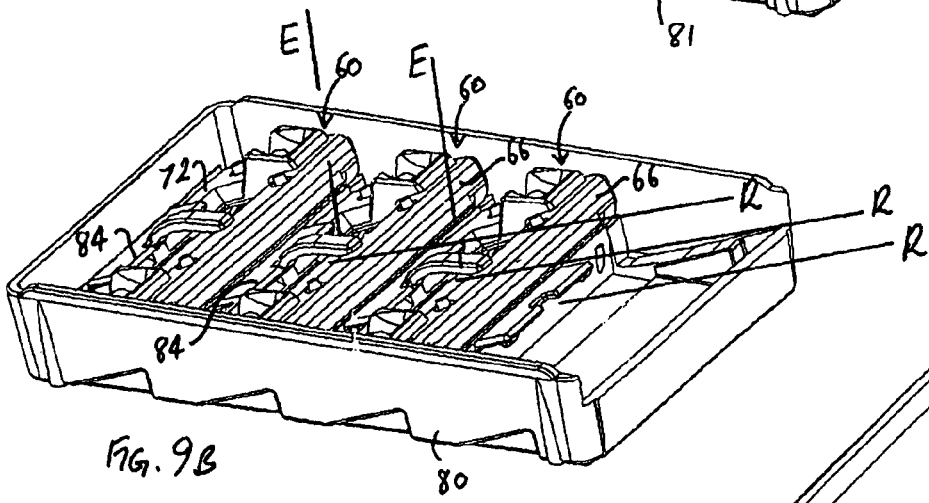

The retaining structure 84 is slightly flexible and has small protuberances 87 on its downwardly facing surface, which contact the flat surface 72 on the bottom side of the cartridge so that the retaining structure 84 is resiliently deflected as the cartridge is inserted into the compartment. When the cartridge reaches its retained position, the protuberances engage the chamfer 75 to hold the cartridge in position as shown in FIG. 9B with its trailing side wall 67 lying adjacent the support wall 86.

It will be noted that the retaining structure 84 extends in the length dimension L2 of the cartridge (i.e. in the transverse dimension of the dispenser) for less than the length L1 of the cartridge. This enables the mounting portion 30 of the handle to engage those regions of the flat surface 72 lying between the ends of the retaining structure and the ends of the cartridge when the handle is attached to the cartridge in its retained position, so that once the cartridge is withdrawn from the dispenser, it is more securely supported over the whole extent of its bottom side in fixed relation to the mounting portion against forces applied during shaving.

The retaining structure also includes a recess 88 for receiving an end region of the curved bar 76 in the retained position of the cartridge.

In alternative embodiments, each compartment may include a retaining structure which is a part of a unitary retaining structure extending between all of the compartments.

The mounting portion 30 of the handle comprises a seat and a cartridge engaging structure, the seat comprising abutment surfaces 31, 32, 33. The mounting portion includes a trailing portion 47 which defines a recess 48 between the trailing portion 47 and the flat surface 72 of the cartridge in its installed position. The recess extends along the retraction axis R and opens towards the trailing side 67 of the cartridge so as to receive the retaining structure 84 when the cartridge is in its retained position in the dispenser.

The cartridge engaging structure comprises a pair of resilient cartridge engaging elements 36, each extending substantially in parallel (i.e. within an angle of about 25°, preferably within about 15°, most preferably within about 5°) with an engagement axis E, which extends generally in the height dimension H2 of the cartridge and substantially normal to the shaving plane S in the installed position of the cartridge. An abutment portion 37 extends outwardly from each cartridge engaging element 36 at an angle to the engagement axis.

The cartridge engaging elements 36 are received in the wash-through aperture 74 when the mounting portion 30 is moved towards the bottom side of the cartridge along the engagement axis E so that when the user exerts a threshold engaging force F1 against the cartridge, the cartridge engaging elements are deflected by contact of the abutment portions with the wings 77 until each abutment portion snaps into a respective recess 78 to retain the cartridge 60 in snap-fit relation in the installed position, in which the flat surfaces 71, 72, 73 of the cartridge abut in fixed relation, respectively against the abutment surfaces 31, 32, 33. The cartridge engaging element 36 remains in a slightly stressed condition when the cartridge is in its installed position, so that the sloping surfaces of the abutment portion 37 exert a retaining force against the walls of the recess 78 that urges the cartridge resiliently against the seat.

The mounting portion also includes guide surfaces 34, 35 which are angled obliquely with respect to the engagement axis E, the guide surfaces being adapted to engage corresponding surfaces arranged respectively on the wings 77 and the chamfer 75 on the bottom side of the cartridge so as to locate the cartridge as it moves towards the installed position.

Two digit receiving surfaces 40 are arranged respectively adjacent the distal ends 3' of the arms 3, and comprise generally flat regions adapted to be pressingly engaged by two digits of the user so as to apply the engaging force F1 to the mounting portion 30 so as to urge it into engagement with the cartridge along the engagement axis E.

A moveable cartridge ejection member 41 is also moulded integrally with the mounting portion, and comprises a bar 42 supported by two integral hinge portions 43 and having a digit receiving surface 44 on its upper side and a cartridge engaging surface 45 on its opposite, lower side. The digit receiving surface is adapted to be pressed down by the user's digit, bringing the cartridge engaging surface into abutment with the flat surface 71 of the cartridge so as to apply a threshold disengaging force F2 to the cartridge, which urges the cartridge away from the mounting portion along the engagement axis E and disengages it from the handle. A wash-through aperture 46 is defined between the digit receiving surfaces 40, the bar 42 and the trailing portion 47 of the mounting portion, the aperture 46 communicating with the wash-through aperture 74 of the cartridge so that the blades can be rinsed during use.

Figure 16A:
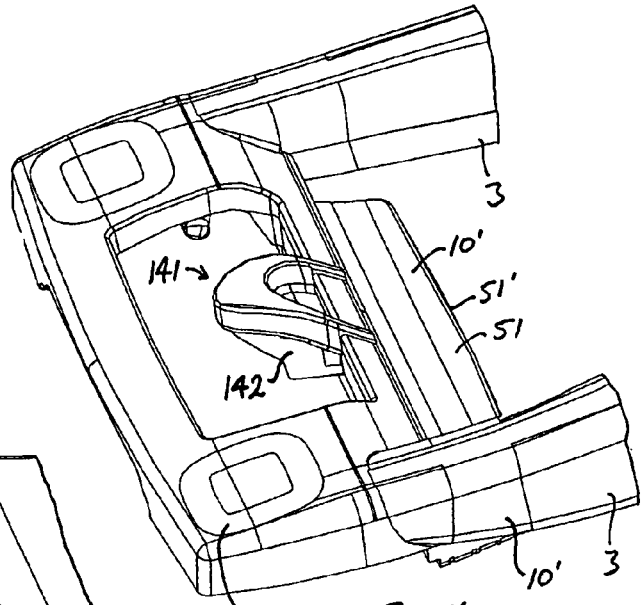
FIGS. 16A and 17 are enlarged views of the mounting portion of a third razor handle.
Figure 16B:
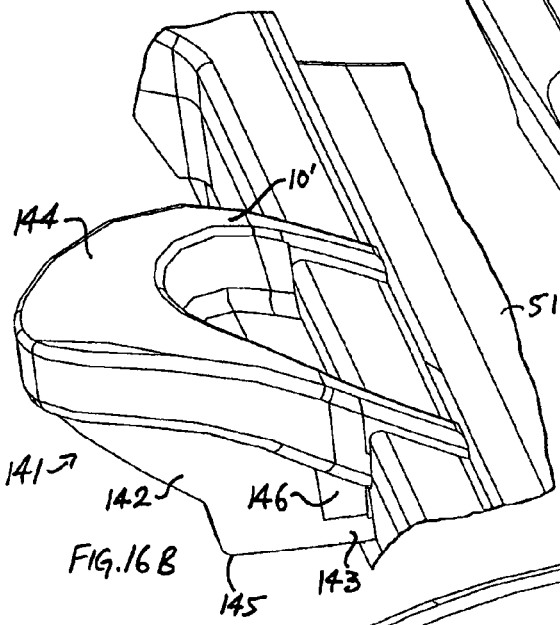
FIG. 16B is an enlarged view of the cartridge ejection button of FIG. 16.
Figure 17:
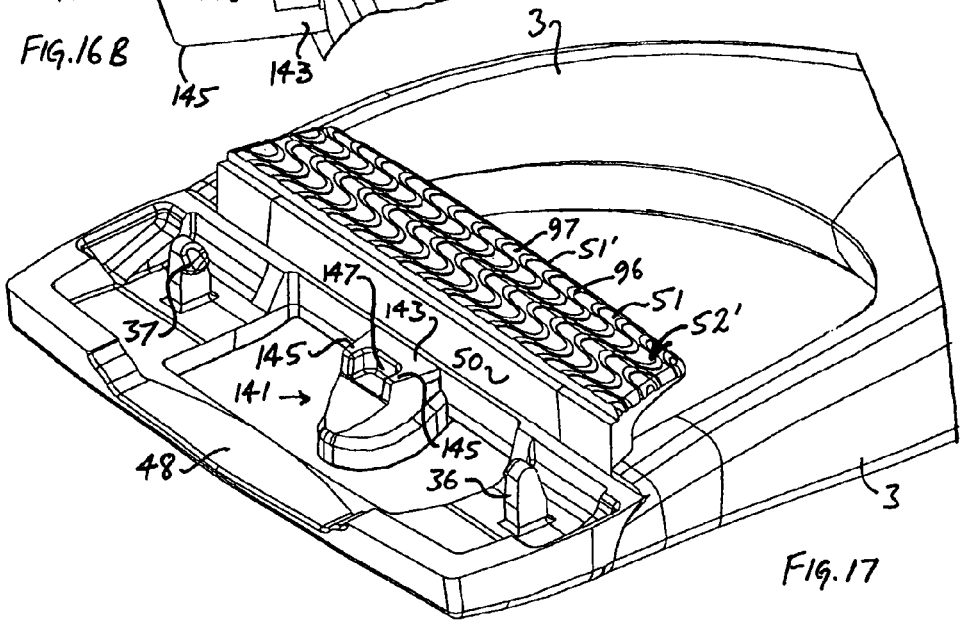

Referring to FIGS. 16A-17, in an alternative embodiment, a third razor handle is formed similarly to the first but has a cartridge ejection button 141 comprising a base portion 142 moulded integrally with the polypropylene base component of the handle and attached to the main body of the mounting portion by an integral ("living") hinge 143. The body 10' of elastomeric material forming the skin-engaging structure 51 and other multiple functional elements of the handle as further described below with reference to the first handle, also extends over the upper surface of the base portion 142 to form a comfortable digit receiving surface 144, and between the base portion 142 and the main body of the mounting portion so as to form an elastic bias portion 146 which acts in tension to provide a restoring force which returns the button 141 to the rest position shown. When the surface 144 is depressed by the user's digit, the button 141 is moved downwards against the restoring force so that the two platforms 145 forming its lower surface engage the flat surface 71 of the cartridge, with the end of the curved bar 76 being received in the recess 147. The distance between the hinge 143 and the outer extremity of the digit receiving surface 144 is greater than that between the hinge 143 and the outer extremities of the platforms 145, so that the button forms a lever which multiplies the force applied by the user to eject the cartridge along the engagement axis E.

Returning to the first embodiment and referring in particular to FIG. 6, the handgrip portion 2, arms 3 and mounting portion 30 are integral parts of one unitary plastics moulding, which comprises a relatively hard plastics (e.g. polypropylene) base component 5 and a continuous body 10 of softer, elastomeric material which is moulded onto the base component 5, e.g. by two-shot moulding. The elastomeric material extends along the arms 3 to provide gripping surfaces 7 on the handgrip portion, and also extends around each digit receiving surface 40 to provide additional grip as well as (since the elastomeric material is preferably a different colour from the base component) a visual indication to the user of the correct position to place the digit.

Each hinge 4 comprises a living hinge 6, which is a thin portion of the base component 5, surrounded by an elastic portion 11 of the body of elastomeric material, the elastic portion providing a restoring force that urges the mounting portion 30 resiliently to the rest position illustrated in FIG. 5A with respect to the handgrip portion. The larger part 11" of the elastic portion 11 is arranged below the living hinge 6 and bonded to the base component 5 during moulding so that it acts in tension to exert the restoring force against the user's skin, while a smaller part 11''' arranged above the hinge acts simultaneously in compression. If the mounting portion is pivoted in the reverse direction, the larger part 11" of the bias element is then placed in compression, making the handle very stiff in the reverse direction. This assists in ejecting the cartridge from the mounting portion as further described below.

The pivot axis P is arranged just in front of the leading side of the cartridge when considered in the shaving direction S1, which ensures that any rotation of the handle about the pivot axis P will load or unload the elastic portion of the hinge and hence vary the pressure of the cartridge against the user's skin, so that the maximum shaving force applied in normal use corresponds to the restoring force exerted by the elastic portion of the hinge. This combination of hinge geometry and elasticity provides the user with control and "feel" for the shaving process, and at the same time protects the user's skin by making it very difficult to apply direct pressure to the skin in line with the pivot axis.

The pivot axis P is advantageously arranged as shown substantially in parallel with the length dimension of the cartridge and with the blades, and the mounting portion is preferably not free to pivot about any other axis. This ensures that the cutting edges of the blades remain generally orthogonal to the plane of symmetry PL3 (FIG. 7) as the cartridge pivots, making it easier to control the position of the blades and to attach and remove the cartridge and helping to prevent any inadvertent slicing motion of the cartridge in the longitudinal direction of the blades which could otherwise cut the skin. Preferably, the pivot axis defines the intersection of two orthogonal planes as illustrated in FIG. 5A, the first plane PL1 lying parallel with the shaving plane S such that the shaving plane lies between the first plane and the user's skin in use; the second plane PL2 lying in advance of the or each cutting edge when considered in the shaving direction.

Most preferably, the pivot axis is arranged proximate the leading side of the cartridge as shown, which is to say, just in front of it in the shaving direction $S_1$ or as close to the leading side as possible, as this enables the user to achieve the required shaving pressure with only very light pressure on the handle and maximises controllability and tactile feedback during the shaving process.

Preferably the handle is curved such that it extends from the pivot axis tangentially to the first plane PL1 in the shaving direction. Preferably, in the rest position, the longitudinal axis XL of the handle (defined as a straight line joining its extremities or, where the handle is forked, the extremity of the handgrip portion and a point lying on the pivot axis P mid-way between the two arms or forks 3) diverges at an angle $\alpha$1 of not more than 45°, preferably not more than 30° from the first plane PL1 in the shaving direction S1, so that the cartridge trails behind the handle in use. In the embodiment illustrated, $\alpha$1 is slightly less than 20°.

Preferably, the engagement axis E is non-parallel with the pivot axis P and non-parallel with the handle; and the engagement axis does not pass through the pivot axis, i.e. it is offset from the pivot axis. This allows the user to engage the mounting portion with the cartridge by a slight rotation of the handle about the pivot axis. Preferably the engagement axis lies in a third plane PL3 (FIG. 7) which is orthogonal to the first and second planes PL1, PL2 and which is a plane of symmetry containing the longitudinal axis XL of the handle. Preferably the engagement axis E is substantially parallel with the second plane PL2 as shown, i.e. it lies at an angle of not more than about 25° from the second plane, preferably not more than about 15°, most preferably not more than about 5°.

In alternative but less preferred embodiments, the forked razor handle may be made without hinges, in which case the forks or arms 3 of the handle are preferably arranged to extend from the mounting portion such that a nominal first axis extending centrally through the two forks of the handle at their respective intersections with the mounting portion lies in the same position as the pivot axis P defined above, the positions of the handle axis XL and the engagement axis E preferably also being as defined above, the term "pivot axis" being construed mutatis mutandis.

Referring again to the embodiment illustrated in FIG. 5A, preferably the second plane PL2 containing the pivot axis P is spaced apart from the leading side wall 66 of the cartridge in the installed position by a distance $d_1$ of approximately one quarter of the width $W_1$ of the cartridge. In less preferred embodiments, this distance could be increased to up to about the width $W_1$ of the cartridge with only a relatively small reduction in the controllability of the shave. A distance $d_1$ of several times the width $W_1$ of the cartridge may make the shave significantly less easy to control, because the increased distance from the handgrip will make the movements of the cartridge less precise as well as requiring the user to apply greater pressure to the handle in order to achieve the required pressure of the shaving plane against the skin.

The mounting portion 30 also includes a fixed skin engaging structure comprising a relatively rigid support wall 50 which extends in the height dimension of the cartridge and forms part of the base component 5, supporting a flexible platform or cantilever structure 51 which forms part of the body 10 of elastomeric material. The flexible cantilever structure 51 extends in fixed relation from the edge of the support wall 50 in the shaving direction S1 and defines a skin engaging surface 52 which is arranged in the shaving plane, which is to say that it lies substantially in alignment with and/or intersecting the shaving plane S in advance of the cartridge, so that it frictionally engages the region of skin that is about to be shaved immediately in front of the cutting edges as the shaving plane travels across the user's skin in use, stretching the skin to erect the hairs in advance of the blades.

In the first razor handle the skin engaging surface 52 is textured to define a pattern of bumps and hollows which act as a temporary reservoir of lubricating fluids applied to the skin (e.g. by the user and/or from a leachable strip arranged on the cartridge), distributing the fluids over the region which is about to be shaved so as to ensure a smooth, close shave. The textured surface 52 is generally flat (i.e. the asperities lie approximately in a flat plane) and extends substantially in alignment with the shaving plane S, closely adjacent and directly in front of the guard 69 and leading side wall 66 of the cartridge in its installed position and in advance of the cutting edges when considered in the shaving direction. Advantageously, the cantilevered platform 51 and surface 52 also distribute the force applied to the user's skin under heavier shaving pressure over a wider area than the cartridge, helping to prevent damage to the skin, and improve tactile feedback by helping the user to feel the position of the cartridge on his skin.

The leading edge 51' of the cantilever structure provides a comfortable bumper which extends substantially in advance of the leading side wall of the cartridge and in advance of the cutting edges, and which is flexible enough for comfort while providing the user with a tactile advance warning which may help avoid shaving sensitive protuberances.

Referring to FIGS. 16A-17, the third razor handle comprises a flexible, elastomeric cantilevered platform 51 extending from a support wall 50 and having a skin-engaging surface 52' comprising a pattern of slightly raised, sinuous ribs 96, with sinuous channels 97 being defined between the ribs, the ribs and channels extending generally in the shaving direction. Lubricating fluids are entrapped in the channels during shaving and distributed laterally (transversely to the shaving direction) by the movement of the ribs, while the continuous channels allow the fluids to pass between the ribs so that the skin area engaged by the blades is lubricated. Like the discontinuous pattern illustrated with reference to the first razor handle, this avoids the adverse effect observed in some prior art razors having elastomeric elements in the form of continuous fins or the like arranged on the cartridge, which tend to wipe lubricant from the skin in advance of the blades.

In yet further alternative embodiments, the skin engaging surface may be arranged in the shaving plane as a surface of one or more flexible, textured ribs or the like, in which case the ribs may be arranged in fixed relation to the handle so that they extend perpendicularly or obliquely across the shaving plane to engage the skin in use. In less preferred embodiments, the skin engaging structure may be a separate part, e.g. a separate elastomeric moulding with a key structure, which is attached to the handle, e.g. by inserting it into a cooperating keyway.

Returning to the first embodiment with reference to FIGS. 1-8, the rigid support wall 50 extends between the two hinges 4 so that it helps to rigidify the mounting portion, preventing differential movement between the hinges. This helps prevent torsional deformation of the mounting portion, ensuring that the two cartridge engaging elements 36 remain in the correct relation and hence ensuring the security of the resilient snap-in cartridge attachment. The support wall 50 also has a flat face 53 which abuts against the leading side wall 66 of the cartridge in the installed position. This helps to locate the cartridge and also shields its leading side wall, ensuring that the cartridge does not become dislodged by heavy transient forces which might result from contact with protuberant body surfaces during shaving.

The unitary co-moulding (multiple-shot moulding) incorporating multiple functional elastomeric elements is economical and easily cleaned, avoiding the accumulation of shaving debris which can impair hinges and other intricate assemblies of prior art razors.

Referring to FIGS. 10A-10E, when the cartridge 60 is in its retained position in the dispenser, the skin engaging structure helps the user to locate the mounting portion in the correct position to engage the selected cartridge by simply resting the mounting portion lightly on the exposed bottom sides of the cartridges in the dispenser and then sliding it along the longitudinal axis of the dispenser. The skin engaging surface 52 rides along the curved bar 76 and the wings 77 on the bottom side of each cartridge when the mounting portion 30 is misaligned with the cartridge (FIG. 10A), which lifts the mounting portion away from the respective cartridge. As the cartridge moves into the correct position, the skin engaging surface 52 rides down the curved bar 76 until the cartridge engaging elements 36 are located above the wash-through aperture of the cartridge and the flat face 53 of the skin engaging structure abuts against the leading side wall 66 of the cartridge, which provides a positive stop so that the user can feel that the handle is correctly positioned (FIG. 10B), with the skin engaging surface 52 lying directly above the retaining structure 84 of the adjacent compartment.

Once the mounting portion is correctly aligned, the user may then press the mounting portion directly downwards onto the cartridge along the engagement axis E with at least the threshold engaging force F1 (FIG. 10C) so as to engage the cartridge, or alternatively may lift the handle and slide it forward to as to engage the next cartridge along.

It is found in practice that the features of the mounting portion, the cartridge and the dispenser cooperate to provide an exceptionally easy and intuitive procedure for engaging the cartridge, which requires very little dexterity and which if necessary can be accomplished by touch alone, and also make it impossible to engage the cartridge in an incorrect orientation so that (unlike, for example, prior art handles which engage the cartridge only at two pivot points) no additional asymmetric feature or the like is required to prevent incorrect engagement.

The snap-fit connection system and the configuration of the engagement axis enable the user to engage the cartridge by pressing the mounting portion down onto the bottom side of the cartridge using the same action as when pressing the shaving plane against the skin in use, conveniently by a slight rotation of the razor handle about the pivot axis so as to advance the mounting portion substantially in translation along the engagement axis E. This is more comfortable and convenient than prior art forked handles which require the user to squeeze the forks together in order to engage the cartridge, particularly for less dexterous users who may have difficulty in holding the forks in the compressed condition while aligning the handle with the cartridge.

Figure 10A:
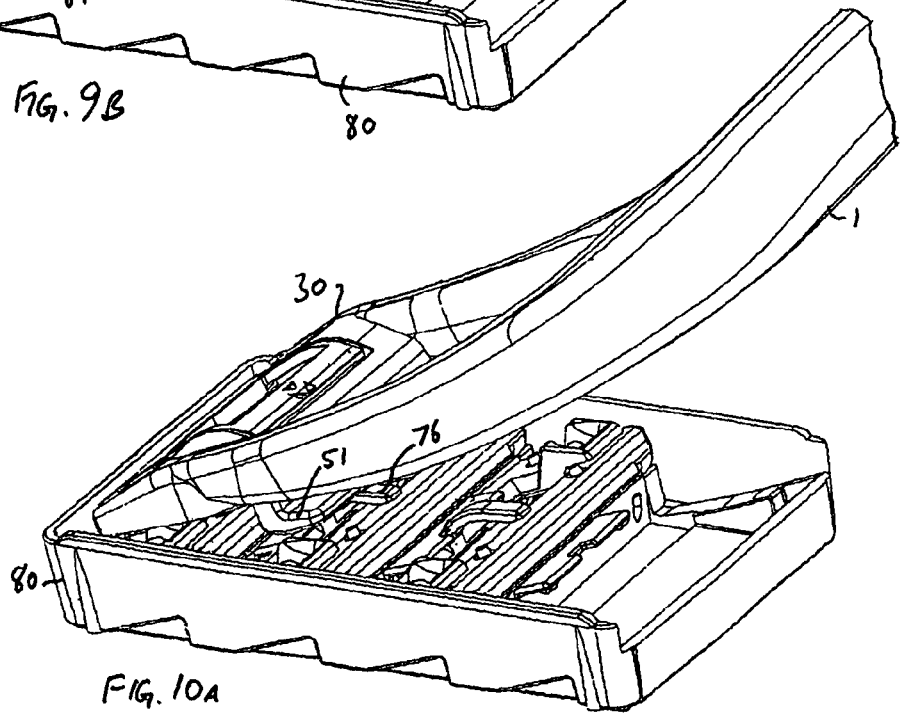
FIGS. 10A-10E show consecutive steps in engaging the first razor handle with the cartridge and retracting the cartridge from the dispenser.
Figure 10B:
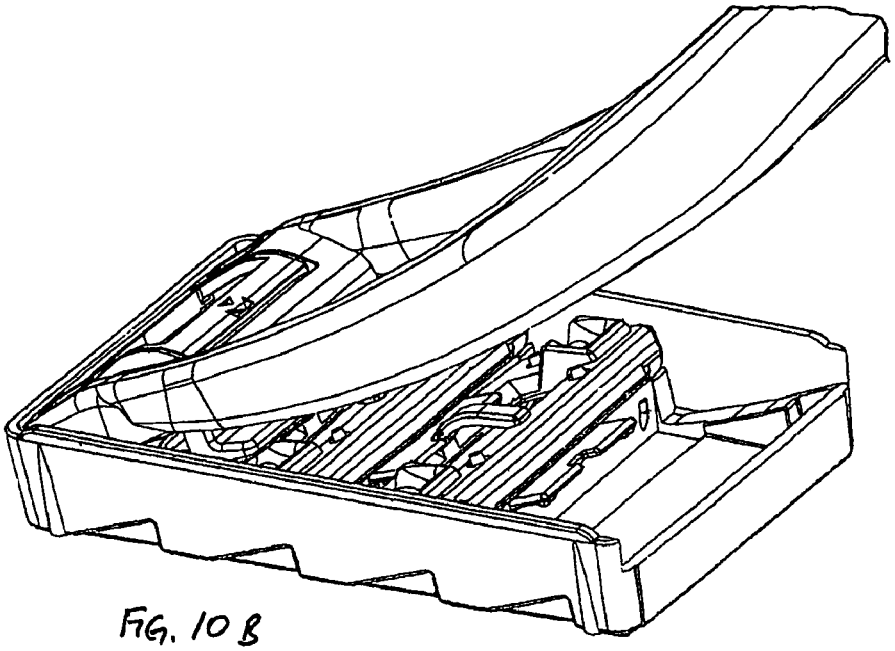
Figure 10C:
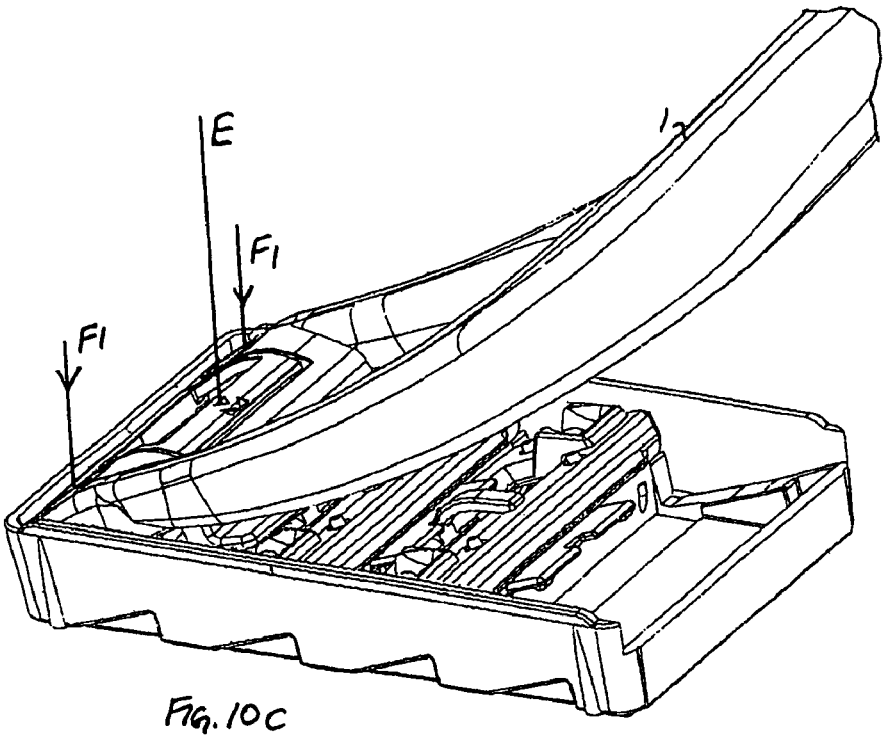
Figure 10D:
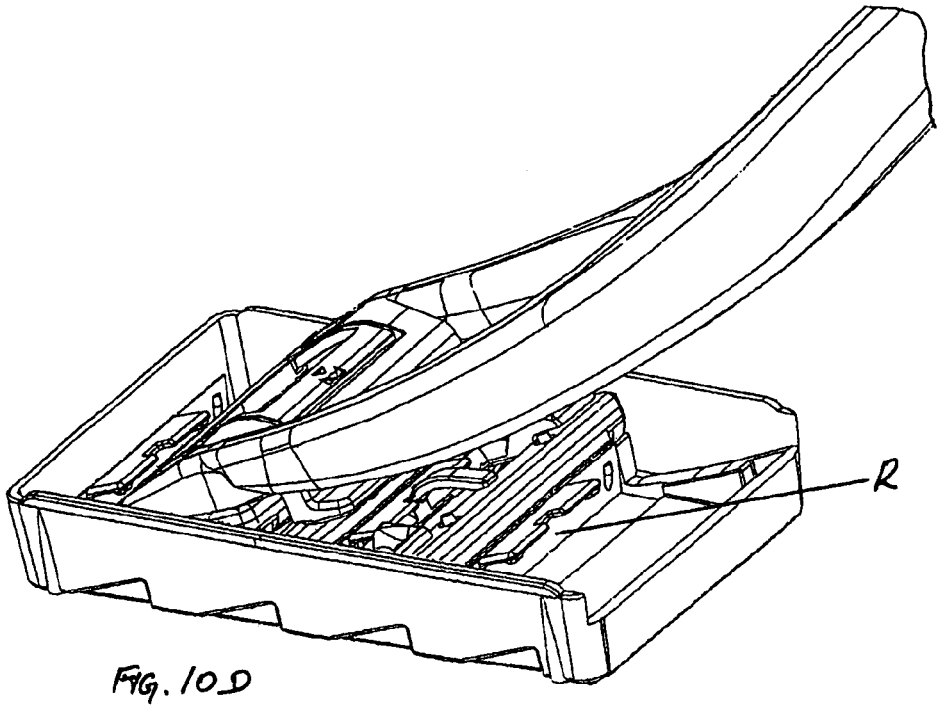
Figure 10E:
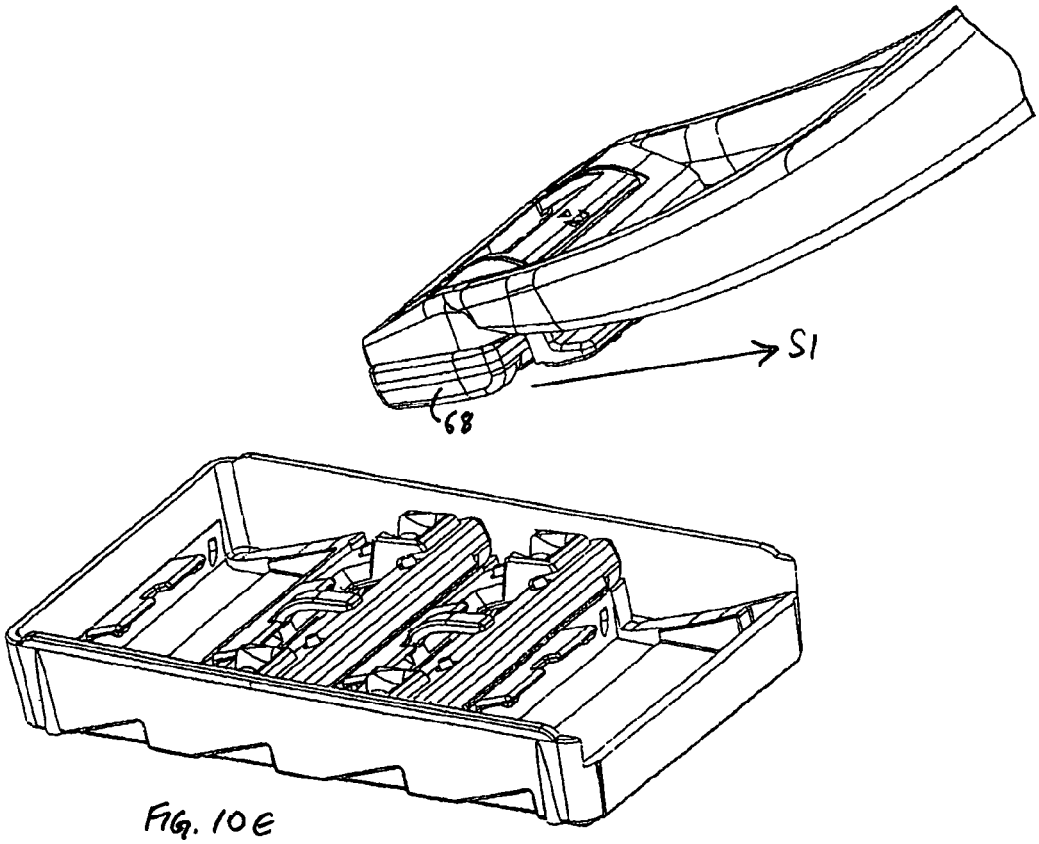
Figure 11:
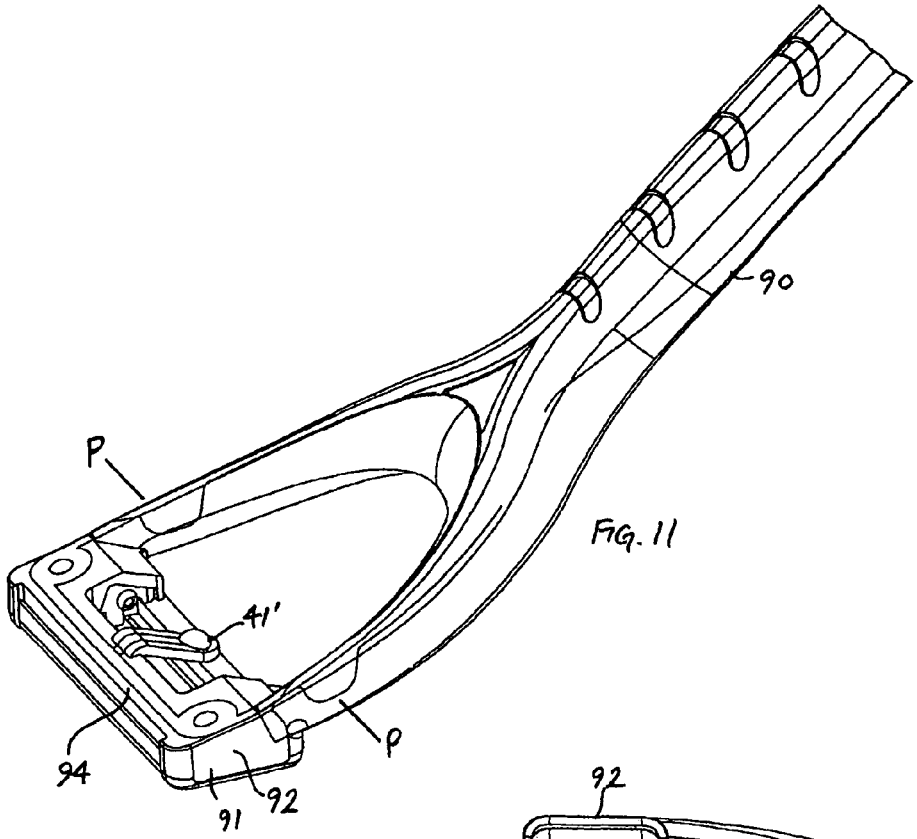
FIGS. 11-13 show a second razor handle with the cartridge in the installed position.
Figure 12:
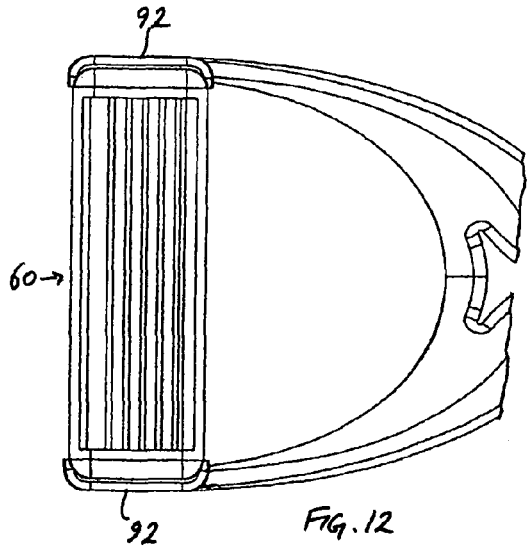
Figure 13:
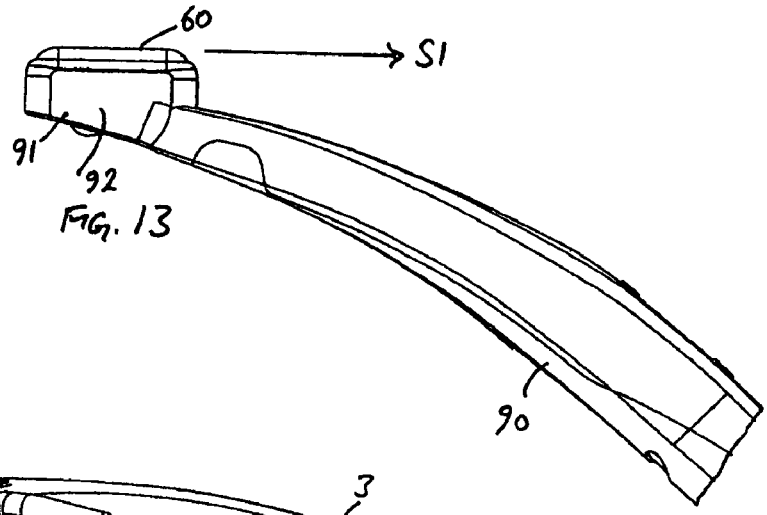
Figure 14:
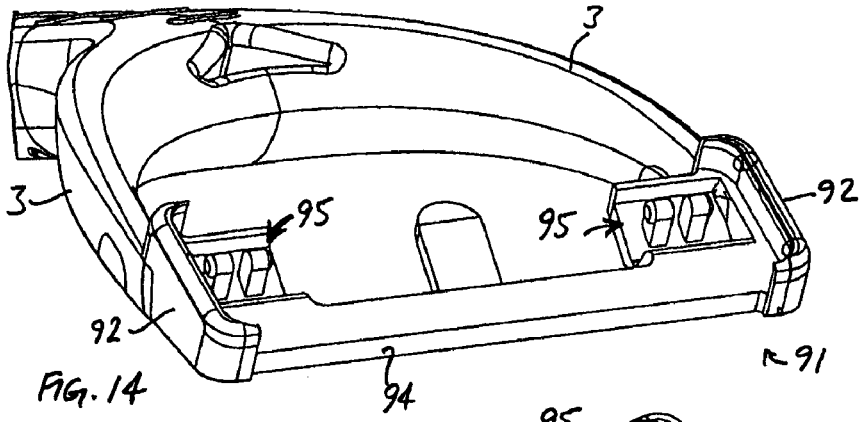
FIGS. 14-15 are enlarged views of the mounting portion of the second razor handle.
Figure 15:
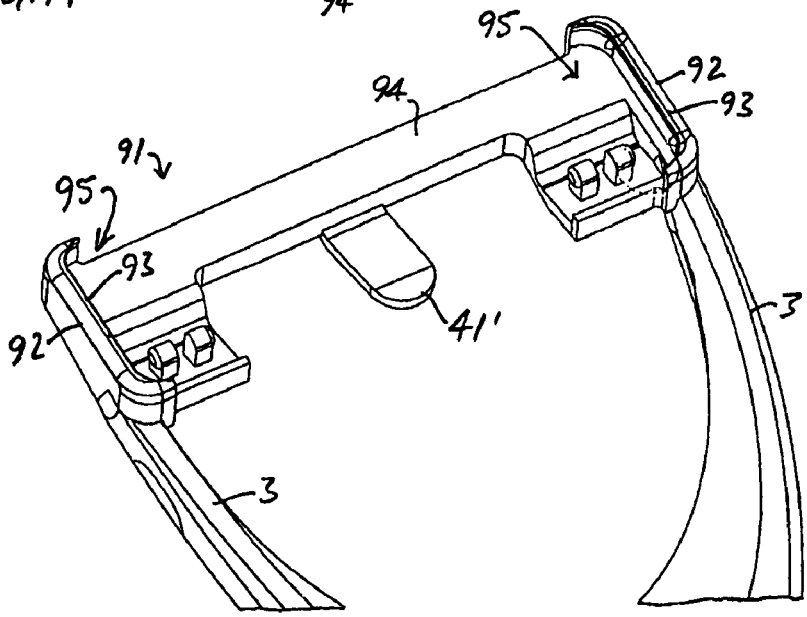

The cartridge 60 is then retracted from the compartment together with the mounting portion 30 along the retraction axis R, which is non-parallel with the engagement axis E and preferably extends substantially orthogonally to the engagement axis (which is to say, at an angle of not more than about 25° from the perpendicular with respect to the engagement axis, preferably not more than about 15°, most preferably not more than about 5°) and obliquely upwardly with respect to the longitudinal axis of the dispenser tray (FIGS. 10D, 10E).

The used cartridge can be returned to the dispenser with equal ease, with the skin engaging surface 52 and the blades and skin engaging surfaces of the shaving plane S riding along the curved bar 76 and wings 77 of each cartridge already retained in the dispenser until the installed cartridge reaches an empty compartment; continued movement of the handle then inserts the cartridge into the compartment so that the retaining structure 84 enters into the recess 48 between the cartridge and the mounting portion.

Since the handle includes hinges between the mounting portion and the handgrip portion, the user may apply the necessary threshold engaging force F1 by pressing down with two digits against the digit receiving surfaces 40 of the mounting portion (FIG. 10C). Similarly, the threshold disengaging force can be applied by pressing down with the digit against the digit receiving surface 44 of the cartridge ejection member while lifting the handle away from the dispenser.

However, if preferred, it is found in practice that the cartridge can be engaged with the handle, retracted from the dispenser, returned to the dispenser and disengaged from the handle, entirely by the pressure of the user's hand on the handgrip portion 2.

In order to engage the cartridge, the mounting portion is positioned above the cartridge and the handgrip portion is rotated about the pivot axis P, with the resilient elastomeric elements of the hinges transferring the threshold engaging force to the mounting portion. This engages the cartridge engaging elements 36 so that the cartridge can be retracted from the dispenser in its installed position. Preferably the engagement axis is substantially normal to the shaving plane (i.e. within about 25° from the perpendicular with respect to the shaving plane, preferably within about 15°, most preferably within about 5°). Forces applied during shaving thus tend to urge the cartridge against the seat, so that it does not become dislodged in use.

In order to disengage the cartridge from the handle, the cartridge is first returned to the retained position in the dispenser. The handle is then lifted up away from the dispenser, optionally with a slight twisting movement about the longitudinal axis of the handgrip portion 2. This rotates the hinges in the reverse direction, in which most of the elastic portion 11 is placed in compression so that the hinges are relatively stiff, so that they apply the threshold disengaging force F2 to the cartridge engaging elements 36, which force is reacted against the retaining structure 84. This disengages the mounting portion from the cartridge leaving the cartridge retained in the dispenser by the retaining structure 84.

Since the snap-fit connection requires a threshold engagement force to be applied, it is important in order to avoid any risk of injury that the user does not touch the blades when engaging or disengaging the cartridge. Preferably the user should not need to handle the cartridge at all. Since the mounting portion is snap fitted to the bottom side of the cartridge, the cartridges may be arranged in the dispenser with the blades facing down and accessed through the open upper side of the dispenser, which protects the user from the blades and simplifies the dispenser design. The process of engagement and disengagement of the cartridge is also safe and convenient because the engaging or disengaging force is applied downwards towards the table or other flat surface on which the base of the dispenser rests.

Referring to FIGS. 11-15, in an alternative embodiment, a second razor handle 90 is generally similar to the first handle, but provides a mounting portion 91 having a cartridge engaging structure comprising a pair of receptacles 95, each comprising a resilient wall 92 which extends generally in the direction of the engagement axis E and has an incurved edge 93 which is adapted to engage the rounded contours of the outer surface of the corresponding side wall 68 of the cartridge 60. The two receptacles are joined by a bar 94 carrying the cartridge ejection member 41'.

In a less preferred embodiment, the bar 94 may be omitted so that the two receptacles 95 are joined together only by the arms 3, the mounting portion thus comprising two separate parts 95 with each part being arranged to engage the respective end of the cartridge in snap-fit, sliding or other mechanical relation. Since the mounting portion then does not extend between the two hinges, the two parts of the mounting portion are constrained to move together about the pivot axis P, only by their mutual attachment to the cartridge, which attachment must then be made firm enough to avoid torsional deformation between the two parts 95 in use.

In summary, a preferred shaving system comprises a bifurcated razor handle comprising a unitary, two-shot plastics moulding having a pair of hinges with elastomeric springs 11 joined by a cartridge mounting portion which receives the bottom side of a generally flat, multi-blade cartridge in fixed, snap-fit relation. The cartridge is retained in a dispenser beneath a resilient leaf and pressed onto the mounting portion along an engagement axis normal to the shaving plane, the leaf being received in a recess between the mounting portion and the cartridge. The cartridge is then retracted from the dispenser along a retraction axis substantially parallel with the shaving plane, i.e. within an angle of about 25° with respect to the shaving plane, preferably within about 15°, most preferably within about 5°. The mounting portion includes digit-receiving regions for pressing the mounting portion onto the cartridge, an ejection element for disengaging the cartridge from the handle, and an elastomeric skin-engaging platform arranged in advance of the shaving plane.

Advantageously, the elastomeric skin engaging surface 52 is moulded at relatively low cost as an integral, fixed part of the mounting portion of the re-usable handle. Since the handle preferably includes other elastomeric elements, this is accomplished without any additional manufacturing step and hence at very little cost. Moreover, the skin engaging surface on the handle makes it unnecessary to provide an elastomeric skin-engaging element on each disposable cartridge as known in the art, which makes the cartridge cheaper and more convenient to manufacture (e.g. by a single shot moulding process rather than a co-moulding process), which cost saving is of course multiplied many times over since many disposable cartridges will be used with each handle. Since the cartridge does not include an elastomeric skin-engaging surface, it can also be more compact, which in turn simplifies the design of the dispenser and reduces the size and cost of the display packaging; again, the benefit of compactness is multiplied by the number of cartridges in each package. Moreover, the elastomeric skin engaging surface on the handle can extend as far as required in the shaving direction, whereas if it were formed as part of the cartridge, its size would have to be limited, not only to avoid packaging problems but also in order to avoid forming a lever which could pop the cartridge out of its snap-fit mounting during use.

The elastomeric material gives the skin-engaging surface advantageous frictional properties which help it to engage and stretch the skin. It is found that elastomers falling between 20 and 85 Shore "A" scale hardness are suitable for use in forming the hinges and also have suitable frictional properties for use in forming the skin engaging surface, although if preferred, the skin-engaging surface could alternatively be formed in a separate moulding step from a different elastomer from that used for the hinges.

Suitable elastomeric materials will be readily identified by those skilled in the art, and include for example thermoplastic elastomers such as Santoprene®, manufactured by Advanced Elastomer Systems, LP of Akron, Ohio, USA, an affiliate of Exxon Mobil Chemical Company of Houston, Tex., USA; and Thermolast K®, manufactured by Kraiburg TPE GmbH & Co. KG of Waldkraiburg, Germany.

In yet further embodiments, the skin-engaging surface could be non-elastomeric, and an elastomeric or non-elastomeric skin-engaging surface could alternatively or additionally be arranged on the mounting portion adjacent the trailing side of the cartridge. Of course, in alternative embodiments, the skin engaging structure may be omitted.

In preferred embodiments, the mounting portion carrying the cartridge is pivotably mounted (i.e. mounted for angular deflection, such as about a living hinge) with respect to the handgrip. Depending on the nature and geometry of the cartridge and/or the mounting structure and/or the rigid or flexible structure linking the mounting structure to the handgrip portion, the pivotal movement of the cartridge with respect to the handgrip may include a translation component which moves the pivot axis from its rest position, and the terms "hinge", "pivotable" and "pivot axis" are intended to embrace such arrangements as well as those in which no translation component is present. It is possible for example to articulate the cartridge to the handle using two or more pivot axes, linked by a framework, or alternatively by means of a flexible structure which (like the illustrated embodiment) has no axle. In each case the term "pivot" is taken to mean any flexible or bendable portion which defines the pivot axis, and the "pivot axis" is taken to be that nominal axis, whether static or moving in translation along a straight or curvilinear path, about which the shaving plane is angularly deflected with respect to the handgrip portion.

The side walls of the cartridge may blend smoothly and continuously into the top and bottom sides, rather than meeting the top and bottom sides at defined edges, and the sides and side walls may be generally rectilinear, round, ovoidal, or any other desired shape, the terms "length", "width" and "height" being construed mutatis mutandis. Normally the top side of the cartridge will include skin engaging surfaces comprising both a cap and a guard, but if preferred, one or more skin engaging surfaces defining the shaving plane may also be provided on the mounting portion of the handle.

In yet further embodiments, the handle may include a body portion made from wood, carbon fibre, injection moulded or die-cast metal, or other material. Conveniently, the mounting portion and hinges are moulded as described above integrally with a bifurcated portion and handgrip portion in a two-shot or equivalent moulding process, after which the bifurcated portion and handgrip portion of the finished moulding (comprising a polypropylene or equivalent base component plus an elastomeric component, which provides the gripping surfaces) are glued into a recess in the body portion, which includes an aperture through which the moulding extends so as to provide gripping surfaces on both the upper and lower faces of the handgrip.

Advantageously, the cartridge is engaged with a snap-fit action by a simple movement of the mounting portion along a single engagement axis E substantially normal to the shaving plane, although in less preferred embodiments, more than one engagement axis (requiring consecutive movements or a compound movement of the mounting portion to engage the cartridge) could be provided. In alternative embodiments the retaining structure of the dispenser may be any recess, protuberance or other feature, whether rigid or resilient, which receives, abuts, engages or otherwise cooperates with a corresponding part of the cartridge to retain the cartridge in the dispenser.

In alternative embodiments, it is also possible to engage the mounting portion with the cartridge by means of cooperating sliding surfaces or keyway features, resilient features on the cartridge which engage with cooperating features on the handle, a catch mechanism operable by manipulation of a button or the like by the user, or any other releasable attachment arrangement as known in the art.

Numerous other adaptations will be evident to those skilled in the art on perusing the foregoing description, the scope of the invention being limited solely by the claims.

The invention claimed is:

1. A razor system, comprising:

a bifurcated razor handle including:

a handgrip portion, at least one mounting portion including a seat and a cartridge engaging structure, and two arms arranged between the handgrip portion and the at least one mounting portion so as to permanently connect the mounting portion to the handgrip portion; and a disposable shaving cartridge, comprising:

a top side having a length extending in a length dimension and a width extending in a width dimension transverse to the length dimension, the top side comprising a shaving plane, the shaving plane containing a plurality of cutting edges and a plurality of skin-engaging surfaces, the cutting edges and the skin-engaging surfaces being permanent parts of the cartridge, the cutting edges being arranged one behind the other in a shaving direction so as to exert a consecutive cutting action in use when the shaving plane is moved across a user's skin in the shaving direction, the width dimension extending in the shaving direction;

a bottom side opposite the top side; and a plurality of side walls having a height extending in a height dimension between the top side and the bottom side;

wherein the mounting portion is adapted to releasably retain the cartridge in fixed relation to the mounting portion;

wherein the cartridge engaging structure is adapted to engage the cartridge in snap-fit relation when the mounting portion is moved towards the bottom side of the cartridge along an engagement axis so as to exert a threshold engaging force against the cartridge, and thereafter to retain the cartridge in an installed position in which the cartridge abuts in fixed relation against the seat;

wherein the top side of the cartridge is arranged in fixed relation to the mounting portion, and to disengage the cartridge when the mounting portion is moved away from the cartridge along the engagement axis so as to exert a threshold disengaging force against the cartridge;

wherein the seat is adapted to abut the bottom side of the cartridge in the installed position;

wherein the mounting portion is pivotable about a pivot axis relative to the handgrip portion, and the pivot axis comprises two hinges, each hinge being arranged on a respective one of the arms;

wherein the mounting portion is attached to both said hinges such that the mounting portion and the cartridge are pivotable together about the pivot axis;

wherein the mounting portion includes a fixed skin-engaging surface, the skin-engaging surface comprising a surface of a body of elastomeric material moulded integrally with the handle; and wherein each hinge includes an elastic portion of the said body of elastomeric material, the said elastic portion providing a return force that urges the mounting portion resiliently to a rest position with respect to the handgrip portion.

2. A razor system according to claim 1, wherein the height of the cartridge is smaller than the width of the cartridge.

3. A razor system according to claim 1, wherein the pivot axis is substantially parallel with the cutting edge or edges, and the mounting portion is not free to pivot about any other axis in use.

4. A razor system according to claim 1, wherein the pivot axis is arranged proximate a leading side of the cartridge when considered in the shaving direction.

5. A razor system according to claim 1, wherein the pivot axis defines the intersection of first and second orthogonal planes, the first plane lying parallel with the shaving plane such that the shaving plane lies between the first plane and the user's skin in use, the second plane lying in advance of the cutting edge or edges when considered in the shaving direction.

6. A razor system according to claim 1, wherein the handgrip portion and the mounting portion are integral parts of one plastics moulding.

7. A razor system according to claim 1, wherein the mounting portion includes a fixed skin-engaging structure having a skin-engaging surface, the skin-engaging surface being arranged in the shaving plane in fixed relation to the mounting portion and in front of the cutting edge or edges when considered in the shaving direction in the installed position of the cartridge, such that the skin-engaging surface frictionally engages the user's skin in advance of the cutting edge or edges as the shaving plane travels across the user's skin in use.

8. A razor system according to claim 7, wherein the skin-engaging structure comprises a platform, the skin-engaging surface comprising a surface of the platform and extending substantially in alignment with the shaving plane.

9. A razor system according to claim 1, wherein each hinge includes an elastic portion of a body of elastomeric material, the body of elastomeric material being moulded integrally with the handle, the said elastic portion providing a return force that urges the mounting portion resiliently to a rest position with respect to the handgrip portion.

10. A razor system according to claim 9, wherein the said body of elastomeric material extends to provide a gripping surface of the handgrip portion.

11. A razor system according to claim 1, wherein the mounting portion defines at least one digit-receiving surface, the digit-receiving surface being adapted to be pressingly engaged by a digit of the user so as to urge the mounting portion towards the cartridge along the engagement axis.

12. A razor system according to claim 11, wherein the mounting portion defines two digit-receiving surfaces arranged respectively adjacent distal ends of the respective arms, the digit-receiving surfaces being adapted to be pressingly engaged by two digits of the user so as to urge the mounting portion towards the cartridge along the engagement axis, and a wash-through aperture is arranged between the digit-receiving surfaces.

13. A razor system according to claim 1, wherein the mounting portion includes a cartridge ejection member, the cartridge ejection member being moveable relative to the seat and including a digit-receiving surface and a cartridge-engaging surface, the cartridge-engaging surface being adapted to engage the cartridge in the installed position so as to urge the cartridge away from the mounting portion along the engagement axis when the digit-receiving surface is pressingly engaged by a digit of the user.

14. A razor system according to claim 13, wherein the cartridge ejection member is biased to a rest position by an elastic portion of a body of elastomeric material, the body of elastomeric material being moulded integrally with the handle.

15. A razor system according to claim 1, wherein the mounting portion defines a recess, the recess extending along a retraction axis between the mounting portion and the cartridge in the installed position of the cartridge, the retraction axis being non-parallel with the engagement axis, wherein the recess is adapted to receive a retaining structure of a cooperating dispenser such that in the installed position, the cartridge can be retracted from the dispenser by moving the mounting portion along the retraction axis.

16. A razor system according to claim 1, wherein the cartridge engaging structure comprises at least one resilient cartridge engaging element extending substantially in parallel with the engagement axis and having an abutment portion extending outwardly from the cartridge engaging element at an angle to the engagement axis, the abutment portion being adapted to engage in a cooperating recess in the cartridge.

17. A razor system according to claim 1, wherein the cartridge engaging structure comprises at least one resilient wall extending generally in parallel with the engagement axis and adapted to engage an outer surface of a side wall of the cartridge.

18. A razor system according to claim 1, wherein the mounting portion includes guide surfaces angled obliquely with respect to the engagement axis, the guide surfaces being adapted to engage corresponding surfaces of the cartridge so as to locate the cartridge as it moves towards the installed position.

19. A razor system according to claim 1, wherein a first axis defines the intersection of first and second orthogonal planes, the first plane lying parallel with the shaving plane such that the shaving plane lies between the first plane and the user's skin in use, the second plane lying in advance of the cutting edge or edges when considered in the shaving direction;

and the handle is curved such that it extends from the first axis tangentially to the first plane in the shaving direction.

20. A razor system according to claim 19, wherein in a rest position of the handle, a longitudinal axis of the handle diverges at an angle of not more than 45° from the first plane in the shaving direction, such that the cartridge trails behind the handle in use.

21. A razor system according to claim 1, wherein a first axis defines the intersection of first and second orthogonal planes, the first plane lying parallel with the shaving plane such that the shaving plane lies between the first plane and the user's skin in use, the second plane lying in advance of the cutting edges when considered in the shaving direction;

and the engagement axis is non-parallel with the first axis and non-parallel with the handle.

22. A razor system according to claim 21, wherein the engagement axis does not pass through the first axis.

23. A razor system according to claim 21, wherein the engagement axis is substantially normal to the shaving plane.

* * * * *